US009091122B2

(12) United States Patent
Millet

(10) Patent No.: US 9,091,122 B2
(45) Date of Patent: Jul. 28, 2015

(54) ANNULAR DEVICE FOR RADIAL DISPLACEMENTS OF INTERCONNECTED PARTS

(75) Inventor: Francois Millet, Antony (FR)

(73) Assignee: Breakthrough Design, Antony (FR)

( * ) Notice: Subject to any disclaimer, the term of this patent is extended or adjusted under 35 U.S.C. 154(b) by 775 days.

(21) Appl. No.: 13/212,911

(22) Filed: Aug. 18, 2011

(65) Prior Publication Data

US 2012/0043133 A1 Feb. 23, 2012

(30) Foreign Application Priority Data

Aug. 20, 2010 (FR) ..... 10 03406

(51) Int. Cl.
*E21B 7/24* (2006.01)
*E21B 7/06* (2006.01)

(52) U.S. Cl.
CPC ..... *E21B 7/067* (2013.01)

(58) Field of Classification Search
CPC ..... E21B 7/067
USPC ..... 175/61, 256, 73, 74, 75, 55; 285/118; 464/18, 19, 20, 21, 147, 151, 153, 155; 403/53, 56, 166
See application file for complete search history.

(56) References Cited

U.S. PATENT DOCUMENTS

| | | | |
|---|---|---|---|
| 2,898,935 | A | 8/1959 | Harris et al. |
| 3,190,374 | A | 6/1965 | Caperan et al. |
| 3,677,354 | A | 7/1972 | Kostylev et al. |
| 4,895,214 | A | 1/1990 | Schoeffler |
| 5,875,859 | A | 3/1999 | Ikeda et al. |
| 6,581,699 | B1 | 6/2003 | Chen et al. |
| 7,188,685 | B2 | 3/2007 | Downton et al. |
| 2004/0226747 | A1 | 11/2004 | Stegmaier et al. |
| 2009/0166089 | A1 | 7/2009 | Millet |

FOREIGN PATENT DOCUMENTS

| | | | |
|---|---|---|---|
| EP | 0850753 | A1 | 7/1998 |
| FR | 2898935 | A1 | 3/2006 |
| WO | 9007625 | A1 | 7/1990 |

*Primary Examiner* — Jennifer H Gay
*Assistant Examiner* — George Gray
(74) *Attorney, Agent, or Firm* — Larson & Anderson, LLC

(57) ABSTRACT

An annular device generates essentially radial displacements of a shaft disposed within the device includes a frame, a swiveling ring and in internal ring with which the shaft is associated. Actuators and guide rods within the housing cause the swiveling ring to rotate relative to the frame and the internal ring to be displaced radially such that a shaft associated with the internal ring is radially displaced. The device is useful for drilling trajectory control devices.

16 Claims, 8 Drawing Sheets

ANNULAR DEVICE FOR RADIAL DISPLACEMENTS OF INTERCONNECTED PARTS

TECHNOLOGICAL BACKGROUND

1. Field of the Invention

The present invention concerns the radial displacements of at least two mechanical parts adjacent to one another, in particular for steerable drilling applications. It concerns in particular drilling which requires accurate trajectory control, in particular in the fields of the petroleum and gas industry, civil engineering, geothermics and more generally in all fields of trenchless underground operations, or even the accurate steering of mechanical parts, such as rolling mill rollers, in particular.

The invention concerns more particularly, whatever the application envisaged, an annular device providing for controlled essentially radial displacements and/or stresses between at least two mechanical parts with a common axis in one or two directions.

2. Description of the Prior Art

Drilling tool steering devices have been described for example in documents WO 90/07625, U.S. Pat. Nos. 6,581,699 and 2,898,935.

These devices meet certain objectives but they do not always make it possible to achieve the best results in all circumstances.

It is generally proposed to use hydraulic radial or tangential jacks, which equates to a simple, reliable and reversible design. But such jacks generally operate at high pressure and offer short travel in such an environment. Furthermore, they are difficult to instrument in order to obtain accurate position control.

Document U.S. Pat. No. 3,677,354 recommends the use of inflatable cushions for displacement in a plane in two directions in a very restrictive annular environment. These offer a high load and expansion capacity with low operating pressures, but they are fragile, especially at high temperature, and lack rigidity.

Document U.S. Pat. No. 5,875,859 suggests using double eccentric systems, which are capable of generating very great stresses and managing a multitude of positions with great accuracy. But the design of these systems makes them generally irreversible and it is essentially proposed that they be associated with needle bearings. Their drive necessitates complex control systems and it generally necessitates two clutches or two independent motor drives.

Also, wedge systems have been proposed, also capable of generating high stresses, but the implementation of which is extremely delicate in an annular space and which are by nature better suited to a unidirectional mode.

It is universally accepted that the reliability of a system is more often inversely proportionate to its complexity, which is itself also an important cost factor, both for manufacture and for maintenance.

According to the present invention, an alternative reversible or irreversible solution has now been developed, radially compact and controllable with accuracy with respect to both stress and position, and also perfectly suitable for drilling, therefore able to operate in the presence of shocks and vibrations, on the basis of research aimed at responding to the above mentioned expectations—in particular those aroused by the attractive nature of the device described in patent FR 2.898.935.

SUMMARY OF THE INVENTION

The present invention is based on the development and preparation of an advantageously bidirectional system for generating essentially radial stress and/or displacements with respect to the X-X axis of the annular system which is described in more detail below.

The first object of the invention is thus a device for generating essentially radial displacements of interconnected mechanical parts, in particular for steerable drilling, said device being designed and constructed to provide for essentially radial displacements of at least one mechanical part with respect to its X-X axis common with that of at least one other mechanical part functionally connected to the first one, said device comprising, in order to provide for such respective displacements of said at least two respective mechanical parts (in particular a shaft or housing which is steerable with respect to a frame in a drilling tool):

(I) two swivelling rings and a frame producing two nested ball joint connections (a) and (b), with respective centres A and B, eccentric by a distance or value $\epsilon$ along said X-X axis common to the two ball joint connections in a position said to be neutral, (II) one or more actuators integrated with said frame in a barrel arrangement about the X-X axis for driving the mechanism, each actuator being connected to the swivelling ring with centre A by a push rod, also called a compression rod, and (III) a guide ring integrated with said frame for guiding the push rods via a bidirectional planar link (e), and also, optionally, functional elements able to provide for start-up, drive and maintenance of correct operation of said device, which is thus annular and isostatic.

Another subject of the invention is equipment integrating a device as described here, in particular drilling equipment intended for applications necessitating accurate trajectory control, for example (but non-limitatively) in the fields of the petroleum and gas industry, civil engineering, geothermics and more generally in all fields of trenchless underground operations, among others.

In such equipment, the device is in a unidirectional version so as to make it possible to constitute a steerable bent housing connection, while it is in a bidirectional version to constitute a drilling tool steering system in turning/rotary mode (known as RSS or "Rotary Steerable System"), arranged to operate dynamically and autonomously or interactively at the bottom of a shaft in both cases.

According to the invention, a bilateral system is thus created for generating essentially radial displacements with respect to such an X-X axis in one or two directions from two nested ball joint connections with respective centres A and B, eccentric by a value $\epsilon$ along said X-X axis common to the two ball joint connections when they are in a position said to be "neutral", and for driving the thus-produced mechanism by means of one or more actuators in a barrel arrangement about the above mentioned X-X axis. In such a system, each actuator activates—independently and in a given direction—the ball joint connection (a) via a push rod guided in a plane defined by the X-X axis and said direction.

In the case of a unidirectional system, the system is driven by at least 1 actuator (unilateral system) or two actuators (bilateral system) in a barrel arrangement about the X-X axis at 180° to one another.

In the case of a bidirectional system, the system is driven by two actuators (unilateral system) in a barrel arrangement about the X-X axis at 90° or by N actuators (bilateral system) in a barrel arrangement about the X-X axis and distributed in this case regularly every 360°/N, the minimum number of actuators then being 3.

In advantageous embodiments, one and/or more of the following arrangements are optionally implemented, separately or in combination, if technically possible:

- When it is desirable to control only a few positions of radial displacements in one or more directions, each actuator is advantageously fitted with one or more position sensors, for example of the magnetic Hall effect type, and also other types of position sensors, if necessary.
- When control of a multitude of positions in one or more directions is required in the context of the above mentioned radial displacement, the actuator or each of the actuators implemented is advantageously fitted with a position sensor of the inductive, capacitive or optical type, for example.
- When it is necessary to monitor and control radial force, each actuator is fitted with a force, current and/or pressure sensor, for example.
- Said at least one actuator is selected from mechanical, electromechanical, electromagnetic, pyrotechnic, hydraulic and electro-hydraulic actuators.

BRIEF DESCRIPTION OF THE DRAWINGS

The invention will be better understood and other objects, advantages and characteristics of it will appear more clearly in the light of the following detailed description of preferred embodiments, which is provided for illustration and is in no way restrictive, while drawings are attached to said description in which.

DETAILED DESCRIPTION OF THE INVENTION

Figure 1:
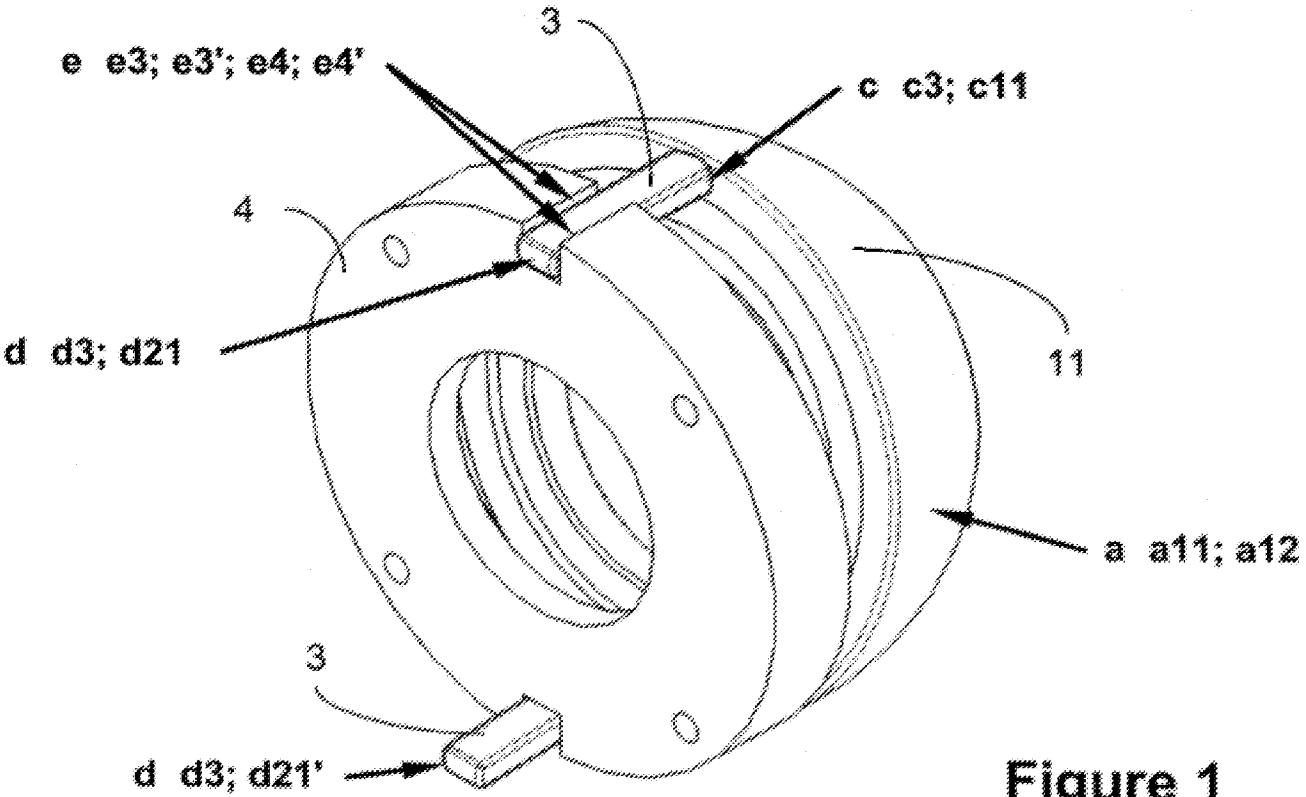
FIG. 1 is the three-dimensional representation of a set of nested ball joints 1 with actuators (not shown) according to the invention, comprising a swivelling and steerable ring 11 in a position said to be "steered", a frame and an internal ring (not shown, and referenced respectively 12 and 13 in FIGS. 2 to 8), push rods 3 and a guide ring 4 for said push rods, integrated with the frame 12. The push rods 3 may be compression rods or similar, providing for the transmission of stress/displacement from the actuator (not shown) to the swivelling ring 11.

With reference to the drawings thus succinctly described, in particular to FIGS. 2-5, which illustrate the invention without limiting it in any way whatever, the system for the production of essentially radial displacements (in particular of the shaft 5 with respect to the frame 12) in one or two directions includes a device comprising a swivelling ring 11, an internal ring or ball joint 13, actuators 2, push rods 3, and a guide ring 4 for said push rods or compression rods.

In the bilateral device according to the invention, as defined above, the nested rings 11 and 13 are displaced under the action of the push rods 3 pushed by actuators 2 and/or 2', and guided by a guide ring 4. Said nested rings are rotatable in their respective housings (a12) and (b11). It should be stated here that the housing for the ball joint 13 is included in the steerable swivelling ring 11; in other words, the convex surface of the ball joint connection (a) and the concave surface of the ball joint connection (b) form part of the same component of the device, namely the steerable ball joint 11.

In one aspect, the device according to the invention essentially comprises:

- a set of nested ball joints 1, made up of a steerable ring 11 comprising a first spherical surface (a11) with centre A, which cooperates with a spherical surface (a12) of a frame 12 with axis X-X; and a second spherical surface (b11) with centre B, which cooperates with a spherical surface (b13) of an internal ring 13, centres A and B being a value $\epsilon$ apart;
- at least one actuator 2 associated with a push rod 3;
- at least one push rod 3, presenting a first end, toric or spherical in shape (c3), with centre C on the side of the swivelling and steerable ring 11, which cooperates with the toric neck (c11) machined in the ring 11; a second end, cylindrical in shape (d3), on the side of the actuator, which cooperates with the neck, also cylindrical (d21), machined in the end (in practice made up of that of the pistons 21) of the at least one actuator 2; and two flat faces (e3) and (e3'), which are parallel and symmetrical with respect to a plane Pc (not shown) passing through the X-X axis and the centre C;
- a guide ring 4, comprising at least one transverse peripheral groove, the sides (e4) and (e4') of which cooperate respectively with the flat faces (e3) and (e3') of the push rods 3; and
- optionally, scraper joints (14) and/or a gasket assembly, arranged so that translation of the end 21 of an actuator 2 by a value $\tau$ (essentially under the action of a pressure P introduced by the duct 23) brings about the rotation of the swivelling ring 11 about point A in plane Pc and centre C, by a value $\alpha$, and the radial displacement $\Delta$ of centre B of the internal ring 13 in plane Pc and thus of the shaft 5 with respect to the frame 12.

Figure 2:
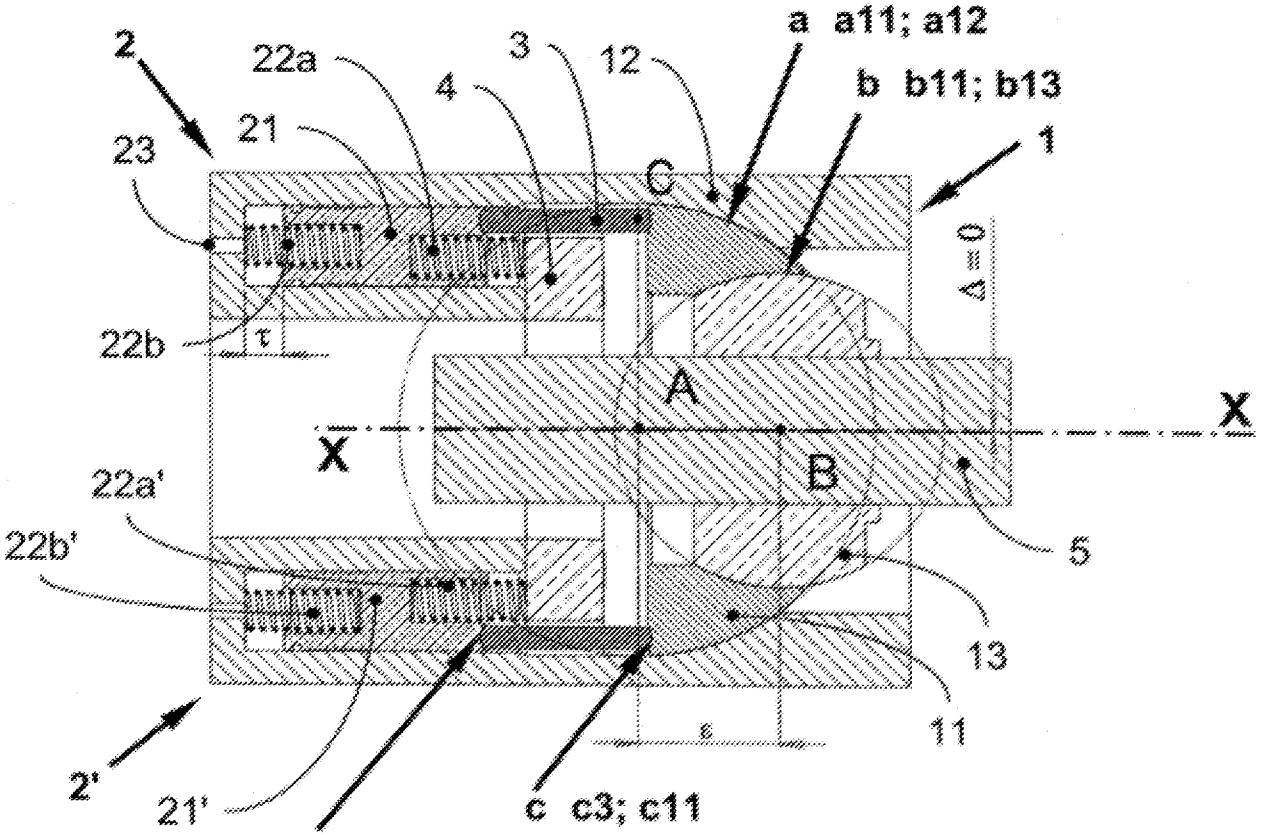
FIG. 2 represents a longitudinal section of the device in a position said to be "neutral" (angle $\alpha$ and radial displacement $\Delta$ equal to 0).
Figure 3:
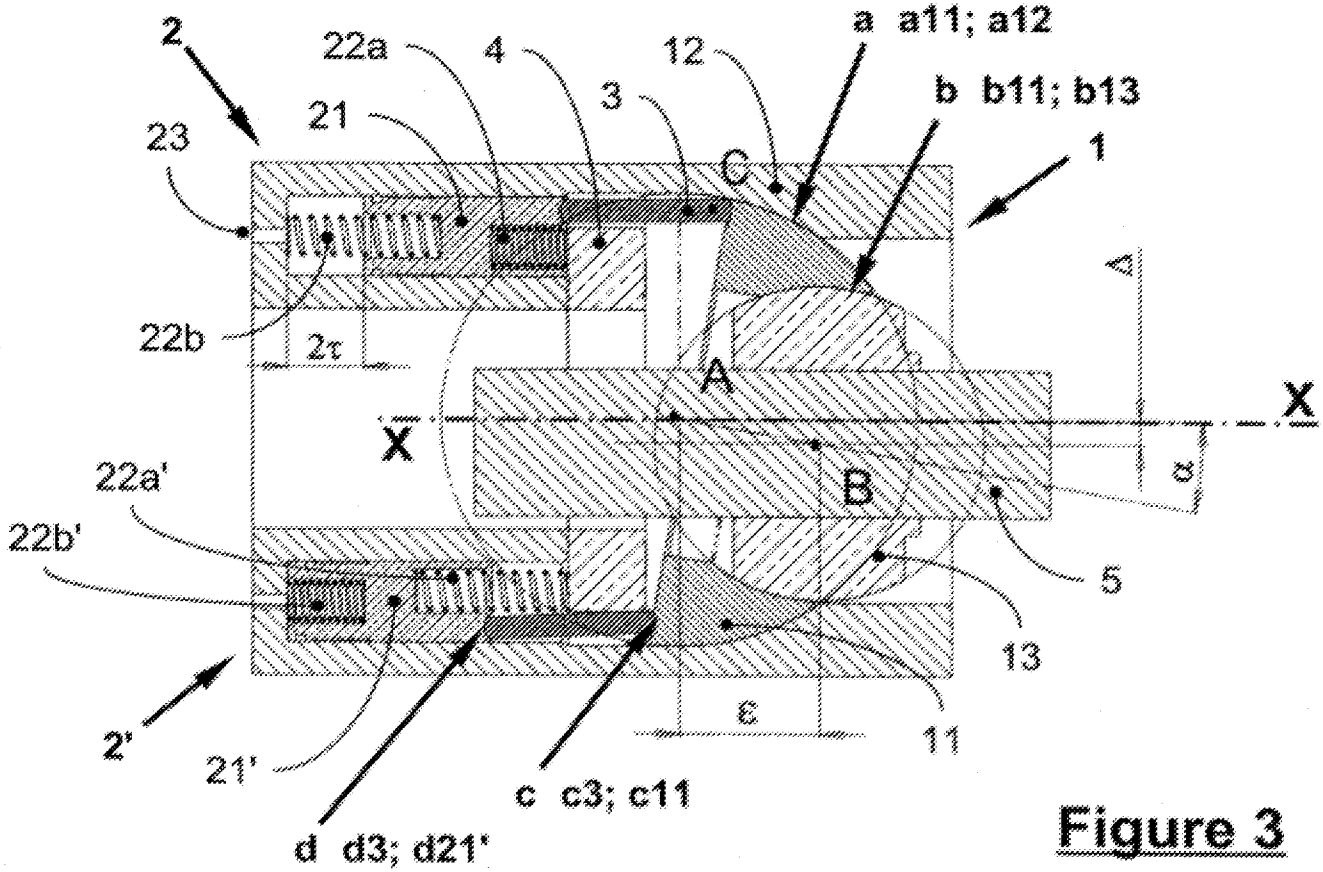
FIG. 3 is a representation of FIG. 1 in a position said to be "steered" to the maximum radial displacement (angle $\alpha$ and radial displacement $\Delta$ at their respective maximum values).
Figure 4:
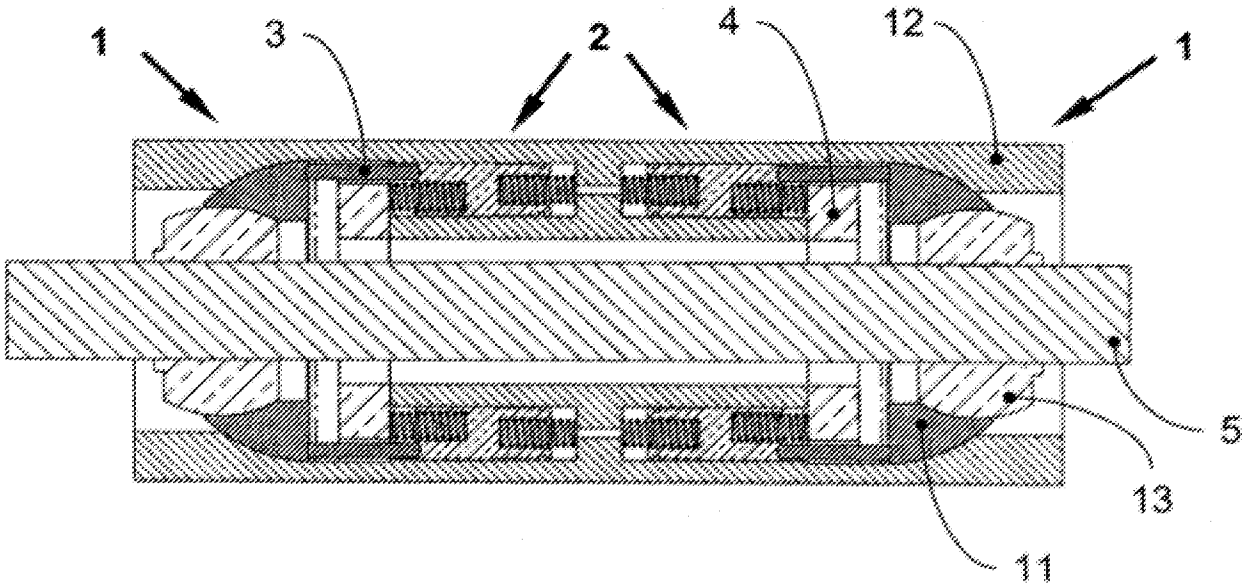
FIG. 4 is a representation in longitudinal section of a double/tandem system, wherein the distance between the two systems described in FIGS. 1 to 3 is optimized. This arrangement is particularly suitable for steering rollers, both according to a dependent embodiment and according to an independent embodiment.
Figure 5:
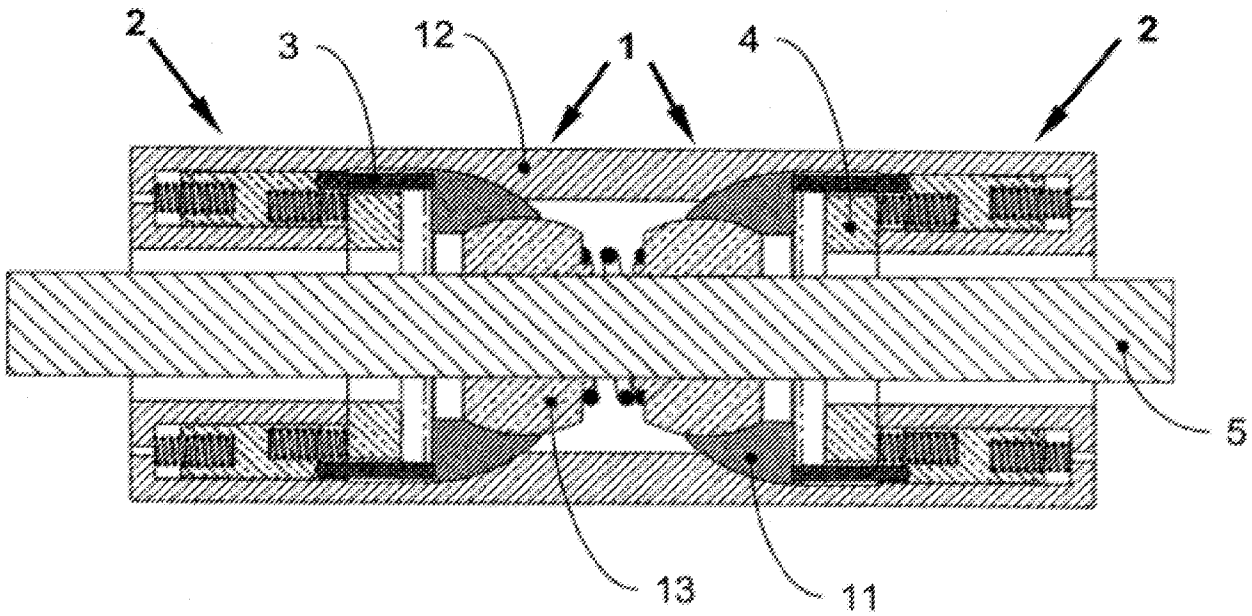
FIG. 5 is a representation in longitudinal section of a double/tandem system, wherein the distance between the 2 systems described in FIGS. 1 to 3 is minimized. This arrangement is particularly suitable for such drilling tool steering systems as described in documents WO 90/07625, U.S. Pat. No. 6,581,699 and FR 2.898.935 according to which a large, concentred force is required to bend the traversing shaft.

Thus, referring to FIG. 2, where the invention is illustrated in a position said to be "neutral", or to FIG. 3 schematically representing a device with two actuators according to the invention in activated position, the following are represented:

- a set of nested ball joints 1, made up of a steerable ring 11 comprising a first spherical surface (a11) with centre A, which cooperates with a frame 12 with axis X-X presenting a spherical surface (a12); and a second spherical surface (b11) with centre B, which cooperates with an internal ring 13 with spherical surface (b13), centres A and B being a value ϵ apart;

two actuator assemblies 2 and 2', made up of hydraulic jacks comprising respectively a piston 21 and 21' and two return springs in "median"/"neutral" position 22*a*, 22*b* and 22*a'*, 22*b'*.

two push rods 3, presenting a first end, toric or spherical in shape (c3), with centre C on the side of the swivelling and steerable ring 11, which cooperate with the toric neck (c11) machined in the ring 11; a second end, cylindrical in shape (d3), on the side of the actuator, cooperates with the neck, also cylindrical (d21, d21'), machined in the end of the pistons 21 and 21' of the actuators 2 and 2'; and two flat faces (e3) and (e3') which are parallel and symmetrical with respect to a plane passing through the X-X axis and the centre C;

a guide ring 4, integrated with the frame 12, intended for guiding the push rods via a bidirectional planar link (e), and comprising for the purpose two mutually opposite transverse peripheral grooves, the two sides of which (e4) and (e4') cooperate respectively with the flat faces (e3) and (e3') of the push rods 3;

optional scraper joints and/or gasket assemblies 14, of any type known to a person skilled in the art, making it possible to avoid an additional frontal joint such as that mentioned in patent FR 2.898.935. Such optional joints are represented by reference 14 (broken down into 14*a*, 14*b* and 14*c* in FIG. 7).

The translations in the opposite direction of pistons 21 and 21' by a value τ under the action of a pressure P introduced by the duct 23 bring about the rotation of the swivelling ring 11 about point A by a value α and the radial displacement Δ of centre B of the internal ring 13 and thus of the shaft 5.

When the hydraulic pressure P is released, the return springs 22*a* and 22*b'* respectively return the pistons 21 and 21' to their median position and, consequently, the swivelling ring 11 to its "neutral" position.

According to an advantageous characteristic of the invention, the jacks 2 are single-acting jacks, which makes it possible to simplify their construction and control. They are in practice fed by hydraulic means known to a person skilled in the art and advantageously fitted with a pressure relief valve, in order to avoid overloads in the set of parts making up the mechanism, and a solenoid valve. The selection of the type of solenoid valve depends in particular on the types of operation required in normal and/or degraded modes or, in other words, on the configuration required for the control system for the device and/or in the event of failure of the power supply or drive device, in order to obtain the best safety and/or the lowest possible consumption. For example, each hydraulic jack of an actuator 2 may be driven by a naturally closed solenoid valve such that the system is always locked or by a naturally open solenoid valve such that the system returns to "neutral" position in the event of an incident.

There may also optionally be a proportional gate valve for the force control system for the jacks, essentially in the case of a hydraulic actuator.

According to an equally advantageous characteristic of the invention, the jacks 2 are preferably electromechanical, such that the steering of the ring 11 can be carried out accurately and irreversibly.

According to another advantageous characteristic of the invention, the steerable ring 11 and the internal ring or ball joint 13 are made from bronze, including beryllium copper, or type 100 C 6 or 100 CD 7 bearing steel to maximize its radial capacity, or non-magnetic stainless steel, in particular for an application in the field of steerable drilling.

The surfaces of the ball joint connections (a) and (b) are advantageously subjected to surface treatment to reduce the friction coefficient and thus maximize the performance and the service life of the contacts.

According to yet another advantageous characteristic of the invention, the push rods are made from materials with a high modulus of elasticity and elastic limit in order to be able to transmit large stresses in a restricted radial space with no risk of bending and flaking of the surfaces of the connections (c) and (d).

The eccentration value ϵ of the two ball joints is between 0.005 and 0.50 times the diameter of the spherical surface (a), and the tilting value is between 0 and 45°. Thus, the device according to the invention presents a small radial size, without, however, any reduction in its capacity to transmit force and radial displacement. It is also of a simple and robust construction, in particular owing to the ability to operate under reduced pressure by playing on the eccentration value, which makes it possible to envisage a particularly broad range of applications, including, and this is an undeniable benefit, in the presence of shocks and vibrations.

Another particular feature of the device according to the invention is its ability to be irreversible or reversible.

When it is desirable that the system has positive safety and returns to its position known as "neutral" (centres of both ball joints aligned on the X-X axis) naturally, the system is then reversible by association with a return system, for example with spring(s), or reversible actuators, advantageously hydraulic or electro-hydraulic and driven by at least one normally open solenoid valve. The return system may comprise one or more springs integrated into each actuator or the flexible shaft (see documents WO 90/07625, U.S. Pat. No. 6,581,699 and FR 2.898.935), or one or more springs acting directly on the swivelling ring 11.

Figure 6:
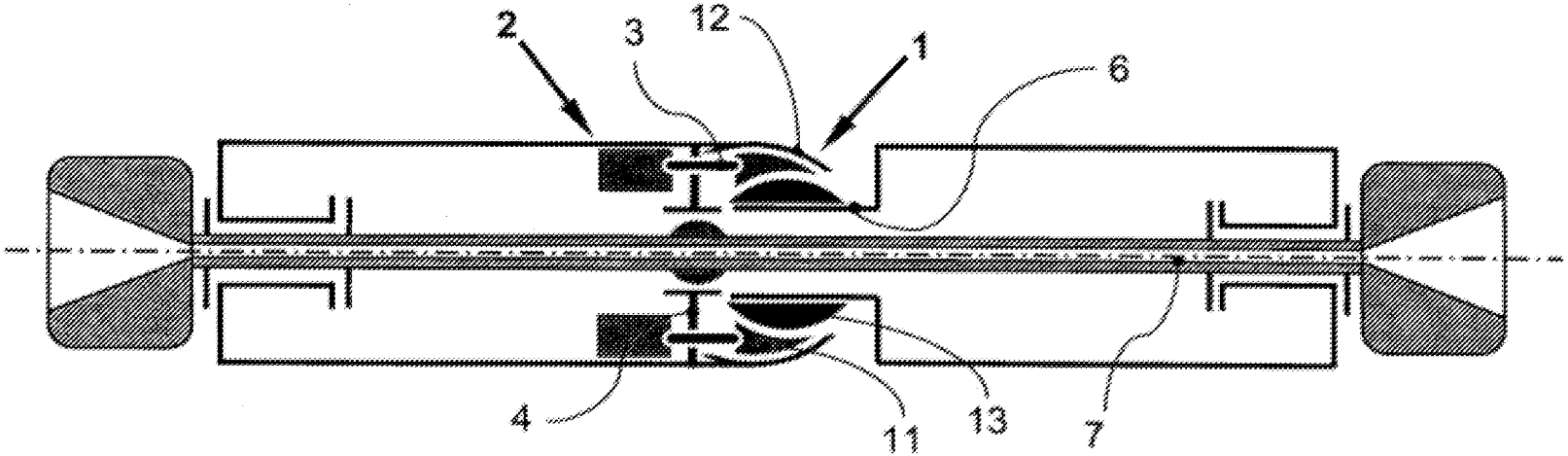
FIG. 6 represents in longitudinal schematic section a steering device for steerable drilling in accordance with patent FR 2.898.935, illustrating an application of the present invention.
Figure 7:
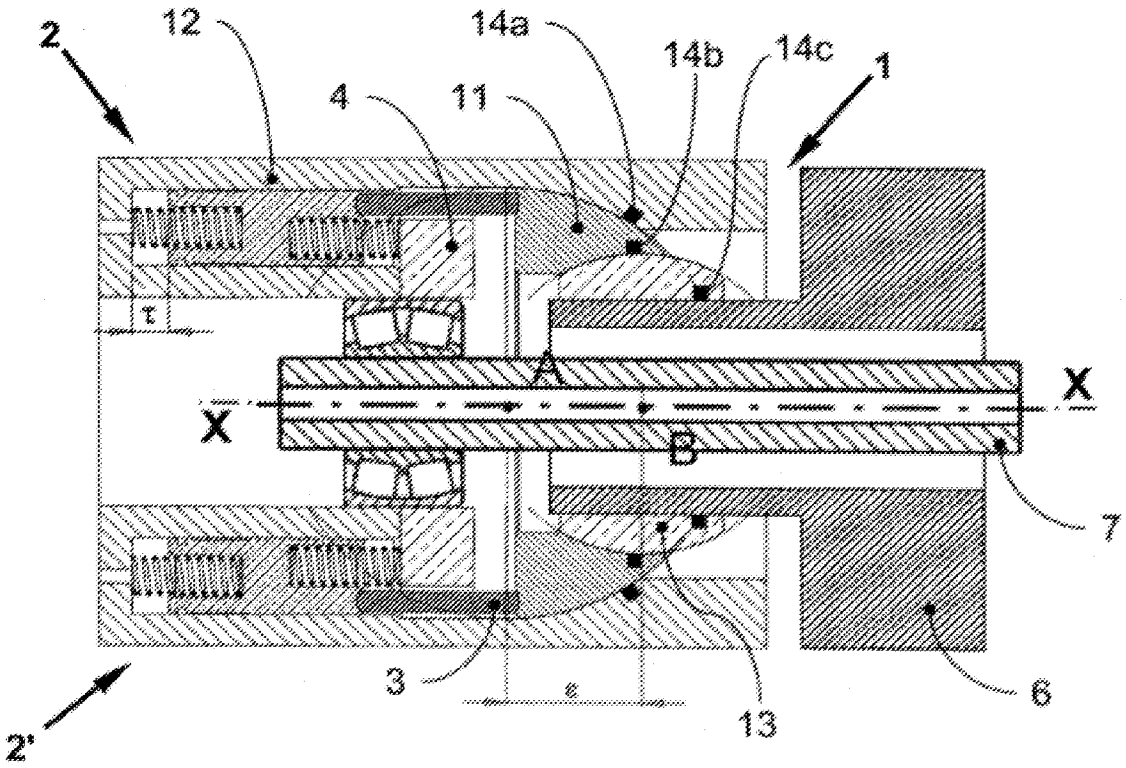
FIG. 7 represents in longitudinal section a device according to the invention, integrated into a system according to FIGS. 6; 14*a*, 14*b* and 14*c* denote a gasket assembly, while 6 denotes in this case the end of the steerable housing and 7 denotes the bendable or flexible connecting shaft.
Figure 8:
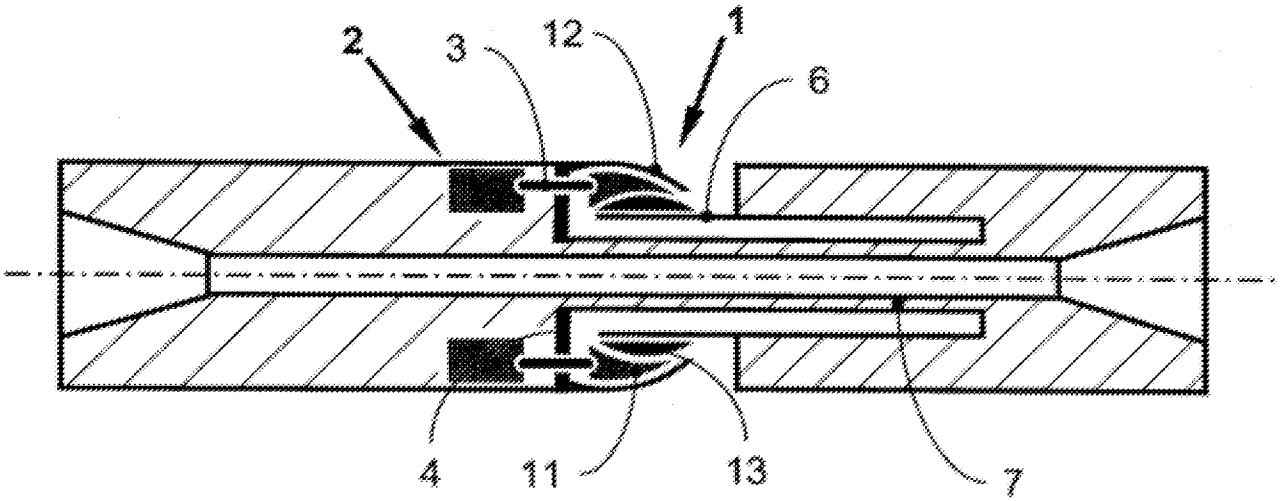
FIG. 8 represents in longitudinal schematic section a steering device for steerable drilling in accordance with the teaching of document U.S. Pat. No. 7,188,685, illustrating another application of the present invention.

Such a return system is arranged and controlled as a function of the eccentration value ϵ, the performance of the two ball joint connections (a) and (b), the reversibility of the actuators 2, and the rigidity of the shaft 5 (or the part referenced 7 in the case illustrated in FIGS. 6 to 8, which corresponds to the application in the technical solutions described in documents WO 90/07625, U.S. Pat. No. 6,581,699 and FR 2.898.935).

When it is desirable that the system is irreversible, namely that it remains in position in the event of malfunction of the associated drive system, the actuators are preferably also irreversible, advantageously electromechanical.

Yet another particular feature of the device according to the invention is the fact that the recommended means provide for the transmission of the stress from each actuator 2 to the swivelling or steerable ring 11 through push rods 3 presenting:

an end (c3), toric or spherical in shape, said end (c3) cooperating with the neck (c11) machined in the swivelling ring 11 and advantageously toric, forming a point connection (c) with centre C;

an end (d3), advantageously cylindrical in shape on the actuator side, said end (d3) cooperating with the neck, also cylindrical (d21), machined in the active end of the actuator 2, forming a linear contact (d);

and two flat faces (e3) and (e3'), parallel and symmetrical with respect to a plane passing through the X-X axis and the centre C, qui cooperate with the sides (e4, e4') of the neck of the guide ring 4, forming a flat bilateral connection (e).

This fundamental provision guarantees the isostatism of the system, prevents the angular jamming of the swivelling and steerable ring 11 with respect to the actuators 2 and makes it possible appropriately to maximize or minimize the number of actuators and also the lever arm by arranging the push rods over a respectively maximum or minimum diameter in order to optimize the stresses of the actuators and the rate of displacement.

Thus, the radial size of the device can be reduced as much as possible without compromising its force, displacement, accuracy and reversibility or irreversibility capacities, by adapting the eccentration value $\epsilon$ of the centres A and B of the ball joint connections respectively (a) and (b), the performance of said ball joint connections, the number, diameter of distribution and angle of inclination of the push rods 3, and also the number, type, force and accuracy of the actuators 2 to the requirements of the application envisaged, hence a potentially wide range of applications.

In the construction known as double/tandem (see FIGS. 4 and 5), the drive for each of the deviation devices may be symmetrical or asymmetrical and, in the latter case, independent.

One of the benefits of the invention is its simple and robust construction, making use of principally surface contacts, mechanically very capacitive, with regard both to radial load and in the event of shocks and/or vibrations, in comparison with the point connections on balls or linear connections on needles. Also, such a system according to the invention produces maximum damping capacity.

In absolute terms, the above mentioned surface contacts are accompanied by one or more point contacts (c), but this may be replaced, if so desired, by swivelling pads of a type known to a person skilled in the art.

The device according to the present invention is thus simple and radially compact and resistant to shocks, temperature and vibrations. It is thus generally perfectly adapted for the constraints currently encountered and taken into account in design imposed by various factors and more particularly for drilling tool steering systems as described in the above mentioned documents WO 90/07625, U.S. Pat. No. 6,581,699 and FR 2.898.935.

Although the invention has been described above principally with reference to drilling, a person skilled in the art will understand that it can have multiple other applications, for example in all fields where accurate steering is required for mechanical parts and/or under high loads, such as rolling mill rollers, among other things.

The invention claimed is:

1. A device for generating a radial displacement of a mechanical part disposed within the device, said device comprising:

an annular frame (12) extending longitudinally around an axis X-X, a swiveling ring (11), and an internal ring (13), said frame (12), swiveling ring (11) and internal ring (13) interacting to form two nested ball joint connections with respective centers A and B, said centers A and B being disposed on said axis X-X when said device is in neutral position and separated by a distance $\epsilon$, one or more actuators (2) integrated with said frame, each of the one or more actuators being parallel to and radially displaced from the axis X-X, one or more push rods (3), each of the one or more push rods being associated with one of the one or more actuators;

a guide ring (4) integrated with said frame, said guide ring (4) having one or more bidirectional planar links (e) into which the one or more push rods (3) are received, wherein operation of at least one of the one or more actuators to put the device in an activated position displaces the associated push rod within one of the one or more bidirectional planar links to bear on the swiveling ring (11) and causes the swiveling ring (11) to rotate relative to the frame (12) and the internal ring (13) to be displaced radially away from axis X-X within the frame such that center B no longer lies on the axis X-X, whereby the mechanical part is radially displaced, the mechanical part being associated with internal ring (13).

2. The device according to claim 1, wherein the swiveling ring (11) has a convex spherical surface that cooperates with a concave spherical surface of the frame (12) and the swiveling ring (11) also has a concave spherical surface that cooperates with a convex spherical surface of the internal ring (13).

3. The device according to claim 2, wherein the value of $\epsilon$ is between 0.005 and 0.50 times the diameter of the convex spherical surface of the swiveling ring.

4. The device according to claim 2, wherein at least one of the one or more push rods has a first end having a toric or spherical face about a center C, said first end cooperating with a toric neck on the swiveling ring (11), whereby the end of the at least one push rod pivots within the toric neck when the actuator associated with the at least one push rod is activated.

5. The device according to claim 1, wherein at least one of the one or more push rods has a first end having a toric or spherical face about a center C, said first end cooperating with a toric neck on the swiveling ring (11), whereby the end of the at least one push rod pivots within the toric neck when the actuator associated with the at least one push rod is activated.

6. The device according to claim 1, wherein said at least one of the one or more actuators (2) is selected from the group consisting of mechanical, electromechanical, electromagnetic, pyrotechnic, hydraulic and electro-hydraulic actuators.

7. The device of claim 1, wherein the activation of at least one of the one or more actuators is reversible to return the device from the activated to the neutral position.

8. The device of claim 1, further comprising a scraper joint and/or gasket assembly disposed at a location on the intersection of the swiveling ring and the frame, the swiveling ring and the internal ring, or the internal ring and the mechanical part, the mechanical part being received by the internal ring.

9. The device of claim 1, wherein the mechanical part is a shaft (5,7).

10. The device according to claim 9, wherein the swiveling ring (11) has a convex spherical surface that cooperates with a concave spherical surface of the frame (12) and the swiveling ring (11) also has a concave spherical surface that cooperates with a convex spherical surface of the internal ring (13).

11. The device according to claim 10, wherein the value of $\epsilon$ is between 0.005 and 0.50 times the diameter of the convex spherical surface of the swiveling ring.

12. The device according to claim 10, wherein at least one of the one or more push rods has a first end having a toric or spherical face about a center C, said first end cooperating with a tonic neck on the swiveling ring (11), whereby the end of the at least one push rod pivots within the toric neck when the actuator associated with the at least one push rod is activated.

13. The device according to claim 9, wherein at least one of the one or more push rods has a first end having a toric or spherical face about a center C, said first end cooperating with a toric neck on the swiveling ring (11), whereby the end of the at least one push rod pivots within the toric neck when the actuator associated with the at least one push rod is activated.

14. The device according to claim 9, wherein said at least one of the one or more actuators (2) is selected from the group consisting of mechanical, electromechanical, electromagnetic, pyrotechnic, hydraulic and electro-hydraulic actuators.

15. The device of claim 9, wherein the activation of at least one of the one or more actuators is reversible to return the device from the activated to the neutral position.

16. The device of claim 9, further comprising a scraper joint and/or gasket assembly disposed at a location on the intersection of the swiveling ring and the frame, the swiveling ring and the internal ring, or the internal ring and the shaft, the shaft being received by the internal ring.

* * * * *